US006093861A

United States Patent [19]

Muntz

[11] Patent Number: 6,093,861

[45] **Date of Patent: *Jul. 25, 2000**

[54] LUBRICATING OIL COMPOSITION

[76] Inventor: Pieter Jan Dirk Muntz, 145 Main Street, Osbourne Park WA 6017, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/810,979

[22] PCT Filed: Jan. 25, 1993

[86] PCT No.: PCT/AU93/00034

§ 371 Date: Oct. 17, 1997

§ 102(e) Date: Oct. 17, 1994

[87] PCT Pub. No.: WO93/15168

PCT Pub. Date: Aug. 5, 1993

Related U.S. Application Data

[63] Continuation of application No. 08/654,009, May 28, 1996, abandoned, which is a continuation of application No. 08/523,287, Sep. 5, 1995, abandoned, which is a continuation of application No. 08/256,826, Oct. 17, 1994, abandoned.

[30] Foreign Application Priority Data

Jan. 23, 1995 [AU] Australia ..... PL0531

[51] Int. Cl.[7] ..... C10M 127/02

[52] U.S. Cl. ..... 585/13

[58] Field of Search ..... 585/13

[56] References Cited

U.S. PATENT DOCUMENTS

| | | | |
|---|---|---|---|
| 3,630,905 | 12/1971 | Sorgo | 585/13 |
| 3,712,864 | 1/1973 | Loeffker et al. | 585/13 |
| 3,843,534 | 10/1974 | Gates et al. | 585/13 |
| 3,903,001 | 9/1975 | Gates et al. | 585/13 |
| 3,915,871 | 10/1975 | Bryner et al. | 585/13 |
| 4,228,024 | 10/1980 | Schulz et al. . | |
| 4,737,537 | 4/1988 | Schwabe et al. | 524/474 |
| 5,370,703 | 12/1994 | Kamiya et al. | 585/13 |

FOREIGN PATENT DOCUMENTS

| | | |
|---|---|---|
| 125827 | 10/1947 | Australia . |
| 26 07 614 | 12/1976 | Germany . |
| 209 846 | 9/1982 | Germany . |
| 1087005 | 10/1967 | United Kingdom . |
| 1 401 183 | 7/1975 | United Kingdom . |

*Primary Examiner*—Jacqueline V. Howard
*Attorney, Agent, or Firm*—Larson & Tylor PLC

[57] ABSTRACT

The specification describes lubricating oil compositions containing an additive comprising normal paraffin and/or iso-paraffins and/or naphthenes each of which have from 10 to 20 carbon atoms. Compositions containing from 0.1 percent to 2 percent by volume are disclosed. The compositions are effective in reducing varnishing, sludging chemical by-products and glazing in an engine. The compositions are also useful in automatic transmissions fluid, gear oils and greases.

19 Claims, No Drawings

LUBRICATING OIL COMPOSITION

This application is a continuation of application Ser. No. 08/654,009 filed May 29, 1996; now abandoned which is a continuation of application Ser. No. 08/523,287 filed on Sep. 5, 1995, now abandoned; which is a continuation of Ser. No. 08/256,826 filed Oct. 17, 1994, now abandoned.

The present invention relates to lubricating oil compositions, especially engine oils.

When two metal surfaces move over each other, considerable heat is evolved due to friction. The function of a lubricant is to separate the two rubbing surfaces by a film thereby greatly reducing the coefficient of friction. If this film fails, the frictional heat produced may melt the surfaces causing them to weld together or seize. When conditions are such that a continuous thick (>0.001 in.) film of lubricant separates the solid surfaces at all points, then frictional resistance is controlled by the viscosity of the lubricant. This is referred to as "hydrodynamic lubrication". Under conditions of high speed or high load, thick lubricant films may be absent or incomplete and lubrication of the parts is effected by layers of adsorbed polar molecules. This situation is referred to as "boundary lubrication". Metal surfaces, which are covered by films of metal oxides, are highly polar and hence are not readily "wetted" by non polar hydrocarbon oils. Used alone, hydrocarbon oils are therefore poor lubricants in these circumstances. Lubricants therefore contain additives which either react with metal surfaces or are adsorbed on the surfaces thereby allowing oil to wet the surface or provide boundary lubrication, thus preventing direct metal to metal contact.

Apart from certain speciality products and synthetic oils, the vast bulk of lubricants are based upon hydrocarbons derived from petroleum.

Crude oils contain a number of broad classes of hydrocarbons, the proportions of which vary greatly from oil to oil.

(a) Branched alkanes. These include iso- and anteiso alkanes, and linear derivates of isoprene such as phytane and pristane and degradation products from molecules such as carotene. These compounds have low melting points and so confer low pour points on lubricating oils. They are also stable to degradation by heat and oxygen and have high viscosity indexes, so this iso-paraffin group is the preferred feedstock for lube oil manufacture.

(b) n-Alkanes. The paraffins have similar properties to the iso-paraffins, except that, due to their higher melting points, they raise the pour point of a lube oil.

(c) Cycloalkanes. The naphthenics contain five-membered and six-membered rings with alkyl side chains. They lower the pour point of an oil but they have a low viscosity index.

(d) Aromatics. These are derivatives of benzene, naphthalene and other fused ring systems with alkyl side chains. This group has a low viscosity index and poor thermal stability.

(e) Sulphur compounds. This group forms a substantial proportion of many crudes, especially those from parts of the Middle East. It has similar properties to aromatics, but are usually even less stable.

In order to prepare a suitable lube oil base stock, a manufacturer will select feeds which have appropriate molecular weight ranges and are rich in the desired classes of hydrocarbons (iso-paraffins), and low in aromatics, ONS compounds, and paraffins so that production costs can be kept low. Crudes such as those from Pennyslvania which are ideal for lube oil manufacture are being depleted, so now most manufacturers use a feed stock mix which is carefully selected to meet the product mix required by the market. Some manufacturers upgrade their feedstock by using a severe hydrogenation/hydrogenolysis process called hydrocracking to remove sulphur, aromatics, and to open rings and crack larger molecules.

The residue from the primary distillation of selected crude oils which are rich in iso-paraffins is distilled at reduced pressure (a few mm of Hg) in the presence of steam. Most usually, three fractions are obtained: two distillate cuts and the residue or bottoms. Typical cuts are shown in the table below.

Lubricating Oil Fractions

| Fraction | No. of C atoms | Molecular Weight | Boiling Range ° C. (Plant conditions) |
|---|---|---|---|
| Light (Low viscosity) | 22–36 | 300–500 | 370–500 |
| Medium (medium viscosity) | 29–45 | 400–600 | 450–550 |
| Heavy (high viscosity) | 43 | 600 | >500(residue) |

The desired oily alkane material is extracted from the viscous bottoms product from the vacuum tower using liquid propane (high pressure, 65° C.) in a propane de-asphalting plant. The more polar, high molecular weight polycyclic aromatics are less soluble in liquid propane than are the alkane (paraffin) components and are removed as a hard sludge. Evaporation of the propane leaves the heaviest grade of lubricating oil which is usually referred to as "bright stock".

Each of the lube oil fractions is next treated with a solvent system which selectively removes much of the aromatic and O, N, S material. Phenol and more recently furfural have been widely used in elaborate multistage counter current equipment for this purpose. The immiscible, slightly polar solvent selectively extracts the more polar aromatic material from the hydrocarbon mixture.

n-Alkanes (normal paraffins), which have higher melting points than branched alkanes of similar molecular weight, must be removed to decrease the low temperature viscosity of the lubricating oil. This is accomplished by taking the oil up in a suitable solvent such as a methylethylketone-toluene mixture and chilling 5–10° C. below the required pour point. The n-alkanes are precipitated as "slack wax" which is separated by continuous filtration.

The final stage in manufacture of the base stocks is hydrogenation to convert small amounts of dark-coloured unsaturated material into saturated material and to remove sulphur from sulphur compounds present in the oil.

Lubricating oils are finally prepared by blending base stocks to give oil of the desired viscosity range, then introducing many additives to improve the life and performance of the oil.

The chemical composition of lubricating oils derived from crude oil is particularly complex. Normally lubricating oils contain a high proportion of naphthenic or paraffinic compounds. The hydrocarbons comprising a typical lubricating oil may have from 22 to 70 carbon atoms. Usually the hydrocarbons contained in lubricating oil have very few olefinic bonds. However there may be a significant proportion of hydrocarbons exhibiting aromatic unsaturation. A further description of base lubricating oils can be found in an article by D. V. Brock published in "Lubricant Engineering" Volume 43 pages 184–185 March 1987.

Minor improvements in the performance of a lubricating oil can yield significant economic benefits far in excess of the cost of the additive that provides the improved performance. The present invention is based on the discovery that the performance of lubricating oil compositions can be significantly improved by the addition of small amounts of medium molecular weight paraffins and naphthenes to lubricating oil.

Accordingly the present invention provides a lubricating oil composition comprising a base lubricating oil and an effective amount of an additive comprising an n-paraffin, an iso-paraffin, a naphthene or a mixture of two or more thereof wherein the iso-paraffin and the naphthene each have from 10 to 20 carbon atoms and the n-paraffins has from 10 to 20 carbon atoms when mixed with the iso-paraffin and/or the naphthene and from 14 to 20 carbon atoms when used alone.

The additive may comprise any compound or any mixture of compounds having a carbon number in the range specified. Compounds having in excess of 14 carbon atoms are generally preferred because of their high boiling point and flash point.

The naphthene may comprise from 10 to 90 percent by weight of the additive. The naphthenes may be alkyl, cyclohexanes or alkyl cyclopentanes or any other naphthene normally found in crude oil. The additive may comprise at least 35% naphthenes. Preferably n-paraffins comprise at least 35% of the paraffins.

The lubricating oil composition may contain as little as 0.1 percent by volume of the additive for an improvement in performance to be observed. Preferably, however, the lubricating oil composition of the present invention contains from 0.5 to 1 percent by volume of the additive. Best results have been obtained with about 0.6 percent by volume of the additive.

The additive may comprise a number of paraffins and a number of naphthenes. A number of examples are set out in Table 1.

TABLE 1

| | Approximate Composition (%) | | |
|---|---|---|---|
| Carbon Range | n-Paraffins | Isoparaffins | Naphthenes |
| 12–17 | 50 | 20 | 30 |
| 14–18 | 25 | 55 | 20 |
| 13–20 | 50 | 30 | 20 |
| 10–11 | 99 | 1 | 0 |
| 10–14 | 10 | 45 | 45 |
| 10–11 | 1 | 1 | 98 |
| 11–15 | 99 | 0 | 1 |
| 10–20 | 100 | | |
| 14–18 | 100 | | |
| 10–20 | | 100 | |
| 14–18 | | 100 | |
| 10–20 | | | 100 |
| 14–18 | | | 100 |

Preferred additives are those that can be described as technical white oils. Typical of these are products such as Shellsol T, Shellsol 72L, Shell P878 and Shell P874. These products have the following typical analysis:

| Property | SST | 72L | P878 | P874 |
|---|---|---|---|---|
| Density @ 15° C. | | | 0.8074 | 0.8034 |
| Flash point ° C. | 50 | 80 | 106 | 136 |
| Pour point ° C. | | | −15 | 0 |
| Carbon atom analysis | | | | |
| Naphthenes % | | | 35 | 21 |
| Paraffins % | 100 | 100 | 65 | 79 |
| -n-paraffins mole % | | | 35 | 56 |

The compositions of the present invention may be prepared as compositions ready for use or as concentrates for premixing or mixing in situ e.g. in the sump of an engine. Concentrates may contain as much as 25% of the additive. The effective amount of additive required depends on the ultimate purpose for its inclusion and may also depend upon the additive selected.

The lubricating oil compositions of the present invention are based on commercially available base stocks. The compositions of the invention may include various additives such as dispersants, detergents, oxidation inhibitors, foam inhibitors, pour point depressants and viscosity improvers. A discussion of the function and formulation of lubricating oil compositions can be found in the "Handbook of Lubrication" Theory and Practice of Tribology Volume 1 edited by E. Richard Booser and published by CRC Press in 1983, the contents of which are incorporated herein by reference.

The composition of the present invention may also be incorporated into a grease composition with corresponding improvements in performance. Grease compositions normally comprise a metallic soap and a lubricating oil.

Similarly, the composition of the present invention may be used in other automotive applications such as gear boxes, differentials, etc.

The motor oils of the present invention provide a number of significant advantages over the existing formulations. These include the following.

1. A noticeable reduction in varnishing;
2. A reduction in sludging;
3. Reduced production of harmful chemical by-products such as acids;
4. Improved seal life particularly seals in gear boxes, differentials and engines;
5. Reduced glazing especially when used in the preferred range;
6. Extended life of the engine oil; and
7. Reduced coefficient of friction of surfaces to which it is applied.

The present invention also includes within its scope methods for any one or more of the following:

a. reducing varnishing in an engine;
b. reducing sludging in an engine;
c. reducing the production of harmful chemical by-products in an engine;
d. improving seal life in an engine; and
e. reducing glazing in an engine
f. reducing friction in an engine by incorporating into motor oil used in the engine an effective amount of an additive selected from the group comprising a paraffin, an isoparaffin, a naphthene or mixture thereof wherein the paraffin, isoparaffin and the naphthene are of medium molecular weight and have from 10 to 20 carbon atoms, or part thereof.

Benefits provided by the present invention are illustrated by the accompanying comparative examples.

EXAMPLE 1

The performance of the compositions of the present invention was compared with the performance of the compositions without the additive of the present invention using a pin on ball testing machine. The pin on ball testing machine comprises an electric motor driving a single shaft through a set of pulleys. A rotatable disc having a diameter of approximately 4 cm is attached to the shaft and is rotated at a speed of 1200–1500 rpm. A separate shaft is pivoted at one end of the apparatus so that a hardened steel bearing element can be applied to the rotating disc. A torque wrench type configuration fitted to the pivoted shaft is used to determine the load applied to the rotating disc by the hardened steel bearing element.

Lubricant under test was applied to the bearing surface by splashing lubricant from a bath held at a base of the rotating disc. At all times during the test a continuous film of lubricant was in contact with the bearing.

A series of seven oil samples was tested with the apparatus both with and without the addition of the additive. Samples including the additive contained additive in the ratio of 1:160 additive to base lubricating oil composition.

The test procedure was as follows. With the disc rotating, a piece of coarse wet and dry emery paper was used to smooth any imperfections and score marks from the rotating disc prior to test. The bearing was moved to ensure a fresh unmarked surface was available for contact with the rotating disc. Prepared samples were poured into an oil bath containing approximately 20 to 40 mls and held in close contact at the base of the rotating disc which picked oil up and carried it across the bearing surface. The bearing fixed to the pivoted shaft was lowered onto the rotating lubricated disc and allowed to settle in. A continuous load was manually applied to the handle of the pivoted shaft. The load was maintained and gradually increased until the bearing surfaces began to squeal. At the point when squealing commenced, the torque applied was measured in ft. 1b units. The results are set out in Table 1.

RESULTS FOR OIL ADDITIVE ASSESSMENT

| Sample | Applied Torque, ft. lb | |
|---|---|---|
| | Without Additive | With Additive |
| 1. Shell XMO | 75–90 | 150–160 |
| 2. Shell Marine Oil | 120 | 160 |
| 3. BP Engine Oil | 70–100 | 150 |
| 4. BP Gear Oil | 80 | 150 |
| 5. BP Grease | 130 | 160+ |
| 6. Caltex CXT | 70 | 150 |
| 7. Esso Tiger | 75 | 140 |

The additive used in this experiment was Shellsol T. Similar results were obtained with Shellsol 72L and Shell P878.

The results demonstrate that the oil additive provides enhanced performance under the harsh boundary lubrication conditions utilised.

EXAMPLE 2

Engine Test illustrating anti-varnish benefits:

when added to a 4 liter 6 cylinder engine, which had done over 130,000 kms, and which was beginning to show noticeable bypass—due to "varnishing", and after approximately 4,000 kms running with an oil change after 2,000 kms with additive, all bypass ceased, as observed with the naked eye. The additive used was Shellsol T in the ratio of 1:160. Similar results were also obtained with Shellsol 72L and Shell P878. Combustion was noticeably steadier and more even.

The same experiment was performed with another engine of similar age, and the same results were achieved.

Oil leaks from each of the motors were also reduced and in particular around the crankshaft protrusions.

With the additive included in further oil changes—the result of "no breathing" was continued indefinitely, with the benefit of cleaner oil, next to no oil burning and better running.

Of course along with this other benefits were observed such as improved fuel efficiency, increased engine performance and reduced engine wear.

EXAMPLE 3

Shellsol 72L was added to Shell Spirex HD gear oil in the proportion 1:160 by volume. A Four Ball wear test and a Timkin test according to ASTM standards D-2783 and D-2782 respectively were conducted. The results obtained were as follows:

| E.P. Four Ball West Test | |
|---|---|
| Load Wear Index | 67.2 |
| Weld print kg | 400 |
| Timkin Test | |
| OK Value lb | 75 |
| Score Value lb | 80 |

The results for both tests were higher than average for this type of lubricant. Furthermore no last "Non-seizure Load" occurred in the E.P. Four Ball test according to the definition in ASTM D-2783.

EXAMPLE 4

Shellsol 72L was added to Exxon Superflow 10 W-30 motor oil in the proportion 1:160 by volume. Sequence 6 tests were then performed on the mixture. The Sequence 6 test records engine performance over a 32 hour ageing period.

The formulation showed a 0.8 to 1% improvement in fuel efficiency for 28 of the 32 hours of the Sequence 6 test.

One Sequence 6 test was done, using Shellsol 72L at a proportion 1:600 by volume.

The improvement in fuel efficiency was still between 1 to 0.5 percent till approximately 11 hours. In order words, very small amounts can still produce a very significant effect.

EXAMPLE 5

Supporting evidence that a Sequence 6 test repeated using a formulation comprising Shell P878 or such as P874 and Exxon Superflow 10 W-30 in the same proportions as for Example 4 shows that an improvement in fuel efficiency similar to that of Example 4 but for the full 32 hours ageing period of the test and into the calculation stage, was attainable.

The improved performance of this formulation is attributable to the higher boiling point of the additive as a result of the higher carbon number of its components.

Sealed and laboratory tests reveal that Shell P878 or eveb Shell P874 result in an improvement of friction modification, increase of engine idle speed and an increase in fuel efficiency virtually identical to Shellsol 72L.

EXAMPLE 6

A Sequence 3E test was performed on a formulation comprising Shell P878 with 20% added mixture of paraffins, 18 and 19 carbon atoms, and a base motor oil in the proportion 1:150 by volume. The Sequence 3E test involves running an engine containing the test formulation for 64 hours, pulling the engine down and assessing engine wear, sludge production, varnishing and ring land deposits. Viscosity is measured during the test. The results obtained for the test formulation are compared with results obtained with the base motor oil on the same engine. The formulation showed a marked improvement over the base oil in mostly all characteristics. Cylinder base wear was particularly low.

EXAMPLE 7

In order to simulate an oil change the engine used in Example 6 was re-assembled and run with the similar formulation for a further 6 hours. This test demonstrated the ability of the additive to remove any remaining varnish and sludge deposits and maintain a very high degree of cleanliness during the working life of an engine; in other words preventing deposit build ups. It also the additive particularly works best at the earlier stages of use and where there already exists some build up of various deposits.

EXAMPLE 8

Shell P878 was added to the oil in a rebuilt 454 Chevrolet engine in the proportion 1:200 by volume. After 5 km the engine idle speed increased by 100 to 110 rpm.

EXAMPLE 9

An engine that had used Shellsol 72L, Shell P878 and an assimilation of P874, as additives to its motor oil was pulled down after 170,000 kilometres. The engine had no visible oil stains, acid stains or varnish deposits throughout the bore and the head; neither were there any sludge deposits. In summary the engine was comparable with an engine that had done 30,000 km using normal motor oil.

With respect to wear, the engine showed minimal wear especially for the age of the engine.

What is claimed is:

1. A lubricating oil composition comprising a base lubricating oil having hydrocarbon molecules with between 22 and 70 carbon atoms, and 0.1% to 2% by volume of an additive to improve lubricating properties and reduce varnishing, glazing and sludge build up, said additive comprising an n-paraffin, an iso-paraffin, or a mixture thereof wherein the iso-paraffin has from 10 to 20 carbon atoms and the n-paraffin has from 10 to 20 carbon atoms when mixed with the iso-paraffin and from 14 to 20 carbon atoms when used alone.

2. A lubricating oil composition improved in lubricating properties comprising a base hydrocarbon lubricating oil having hydrocarbon molecules with between 22 and 70 carbon atoms, and 0.1% to 2% by volume of an additive of saturated hydrocarbons selected from at least one member from the group consisting of an n-paraffin and an iso-paraffin, wherein the iso-paraffin has from 10 to 20 carbon atoms and the n-paraffin has from 10 to 20 carbon atoms when mixed with the iso-paraffin, and from 14 to 20 carbon atoms when used alone.

3. A lubricating oil composition according to claim 2, wherein the additive comprises a mixture of said members.

4. A lubricating oil composition according to either claim 2, wherein the additive is an iso-paraffin.

5. A lubricating oil composition according to claim 3 in which the additive is a mixture of a normal paraffin and an iso-paraffin.

6. A lubricating oil composition according to claim 5, wherein the mixture contains at least 40 mole per cent of an iso-paraffin.

7. A lubricating oil composition according to claim 3, wherein the additive is a technical white oil.

8. A lubrication oil composition according to claim 7, wherein the additive has a flash point in a range from 50° C. to 140° C., a boiling point in a range from 180° C. to 320° C., a density at 15° C. in a range from 0.765 to 0.81 kilograms per liter and an aniline point in a range from 78° C. to 97° C.

9. A lubricating oil composition according to claim 8, wherein the additive comprises more than 99% paraffins.

10. A lubricating oil composition according to claim 8, wherein the additive comprises paraffins and the paraffins contain 35 mole per cent of n-paraffins.

11. A lubricating oil composition according to claim 8, wherein the mixture comprises paraffins of which 56 mole per cent are n-paraffins.

12. A lubricating oil composition according to claim 2, wherein the additive comprises saturated hydrocarbons having between 14 and 19 carbon atoms.

13. A lubricating oil composition according to claim 2, wherein the additive comprises saturated hydrocarbons having between 13 and 20 carbon atoms.

14. A lubricating oil composition according to claim 2, wherein the additive comprises mixtures of saturated hydrocarbons having between 13 and 20 carbon atoms.

15. A method of reducing varnishing in an engine which method comprises lubricating the engine with a lubricating oil composition according to claim 2.

16. A method of reducing sludging in an engine which method comprises lubricating the engine with a lubricating oil composition according to claim 2.

17. A method of reducing glazing in an engine which method comprises lubricating the engine with a lubricating oil composition according to claim 2.

18. A method of improving the seal life in an engine which method comprises lubricating the engine with a lubricating oil composition according to claim 2.

19. A grease composition comprising a soap and a lubricating oil composition, wherein the lubricating oil composition comprises a base hydrocarbon lubricating oil and 0.1% to 2% by volume of an additive of saturated hydrocarbons selected from at least one member from the group consisting of an n-paraffin and an iso-paraffin, wherein the iso-paraffin has from 10 to 20 carbon atoms when mixed with at least one member from said group, and wherein the n-paraffin has between 10 and 20 carbon atoms when mixed with the iso-paraffin, and from 14 to 20 carbon atoms when used alone.

* * * * *